US005673883A

United States Patent [19]

Figueroa, Jr.

[11] Patent Number: 5,673,883

[45] Date of Patent: Oct. 7, 1997

[54] BAR DEVICE FOR INSTALLING A PROTECTIVE SHEET OVER A WINDOW

[76] Inventor: Oscar E. Figueroa, Jr., 604 Gaynell Dr., Houma, La. 70364

[21] Appl. No.: 383,118

[22] Filed: Feb. 3, 1995

[51] Int. Cl.[6] ..... E04G 25/00

[52] U.S. Cl. ..... 248/200.1; 248/208; 411/389; 52/202; 49/61; 49/463

[58] Field of Search ..... 248/208, 231.21, 248/354.3, 200.1; 49/61, 463, 465; 52/202; 411/389

[56] References Cited

U.S. PATENT DOCUMENTS

| | | | |
|---|---|---|---|
| 359,394 | 3/1887 | Jones et al. | 411/389 X |
| 457,977 | 8/1891 | Wilkening | 248/200.1 X |
| 1,078,007 | 11/1913 | Stange | 411/389 X |
| 1,891,588 | 12/1932 | Claus | 248/354.3 X |
| 2,543,175 | 2/1951 | Kilgore | 248/354.3 X |
| 2,607,088 | 8/1952 | Schoepfer | 52/202 X |
| 2,694,946 | 11/1954 | Vandal | 248/200.1 X |
| 2,794,217 | 6/1957 | Croft | 248/200.1 |
| 3,329,388 | 7/1967 | Barber | 248/354.3 X |
| 3,948,308 | 4/1976 | Facey | 52/202 X |
| 5,507,118 | 4/1996 | Brown | 49/61 |

FOREIGN PATENT DOCUMENTS

| | | | |
|---|---|---|---|
| 852148 | 10/1952 | Germany | 248/354.3 |
| 299814 | 8/1964 | Netherlands | 248/354.3 |

*Primary Examiner*—Leslie A. Braun
*Assistant Examiner*—Stephen S. Wentsler
*Attorney, Agent, or Firm*—Edwin E. Greigg; Ronald E. Greigg

[57] ABSTRACT

A bar device which can be installed in a window opening to which a sheet of covering material can be secured to protect the window from flying debris resulting from a storm such as a hurricane, tornado, etc. The bar device includes a turnbuckle which is threaded on its opposite ends. Threaded rods are threaded into the turnbuckle. A threaded bolt is secured in some manner to each of the threaded rods to extend perpendicular thereto. A supporting pad is secured at the ends of the threaded rods and the supporting pads are forced against a wall elements defining a window opening in order to secure the bar device in the window opening and a protective cushion is provided on the supporting pads to prevent marring the window opening. Once the bar device is secured in the window opening, the covering sheet such as plywood is secured in place by passing the threaded bolts through suitable holes in the covering sheet and then securing the covering sheet in place by a washer and nut applied onto the threaded bolts.

14 Claims, 2 Drawing Sheets

BAR DEVICE FOR INSTALLING A PROTECTIVE SHEET OVER A WINDOW

BACKGROUND OF THE INVENTION

This invention relates to means for protecting windows from damage during a high wind storm, hurricane or tornado.

Usually for protection of windows, people have used a piece of plywood or some other appropriate covering which has been nailed to the surface of the building with the plywood or covering on the outside of the building and covering the window. Such a covering leaves nail holes in the side of the building which is unattractive and may induce rotting or damage to the siding.

OBJECT AND SUMMARY OF THE INVENTION

It is therefore an object of this invention to provide a bar device which can be secured within the wall elements adjacent the window opening so that a piece of plywood or other covering can be attached to the bar device without damage to the window, window framing, wall surfaces, or the outside of the building.

Another object is to provide a device which can be installed quickly and with very few tools.

Still another object is to provide a means which can be assembled quickly and by inexperienced personnel for protecting a window during a storm.

Yet another object is to provide a means for protecting a window during a storm which can leave a spacing for fresh air, yet it will protect a window from damage during the storm. It is well known that if a tornado approaches it is better to leave a window open so as to equalize interior and exterior air pressure than to close the window. This device will permit opening the window, yet protect the window from damage by being blown out.

The objects of this invention are carried out by use of a bar device which is secured within the wall elements defining the window opening between the window and the outside of the building and a covering is secured to the bar device and secured along the outside of the building so that the covering is tight against the outside of the building or spaced from the building by a spacer.

In the event spacing is desired to allow air flow, the covering could be spaced from the outside by a spacer in combination with the bar device which would leave a space around the periphery of the covering, between the covering and the building, through which air could flow. Also, the covering could be moved upward to provide a space at the bottom or downwardly to provide a space at the top, then air could flow through the spacing left at the bottom or the top.

DETAILED DESCRIPTION

Figure 1:
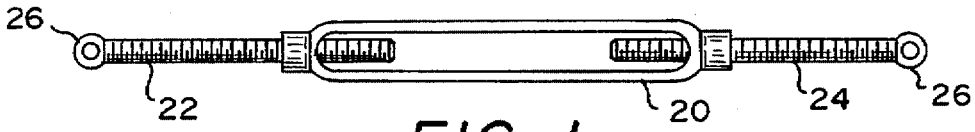
FIG. 1 illustrates an adjusting means for a window bar device.

Now referring to the drawings, there is shown a bar device and associated parts which may be used to install a protective covering such as a piece of plywood for a window to protect the window from damage by flying debris, high winds, etc.

FIG. 1 illustrates a simple bar device including a turnbuckle 20 threaded on opposite ends with opposite threads and oppositely disposed threaded rods 22 and 24 of opposite threads that can be adjusted relative to the turnbuckle to fit into different sized wall elements defining the window opening. Each of the threaded rods have an eyelet 26 on their end which will be discussed later. The bar device shown in FIG. 1 is used with different accessories for installation in a window and to secure a piece of plywood over a window opening. An adapter bolt 28, shown in FIG. 2, includes an eyelet 30 which may be threaded on the inside of the eyelet or not threaded. If the eyelet 30 is threaded on its inside, then the eyelet would have threads that match the threads on the threaded rods 22 or 24. If the eyelet is unthreaded it would just slip over the threaded rods and swing free on the rods. The adapter bolt is used where the surface to which the window bar device is secured is at an angle. Only one adapter bolt 28 has been shown; however, it is obvious that an adapter bolt would be threaded onto or slip over each of the threaded rods 22 and 24 in order to secure a protective covering thereto such as for the pivot bolts 28 and adapter bolt 44 shown in FIG. 7.

Figure 3:
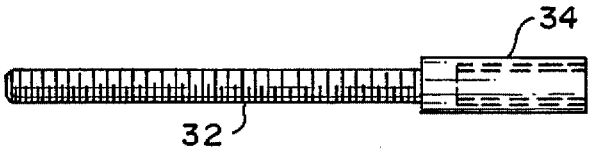
FIG. 3 illustrates an extension for use with the window bar device for use with extra wide or long openings.
Figure 7:
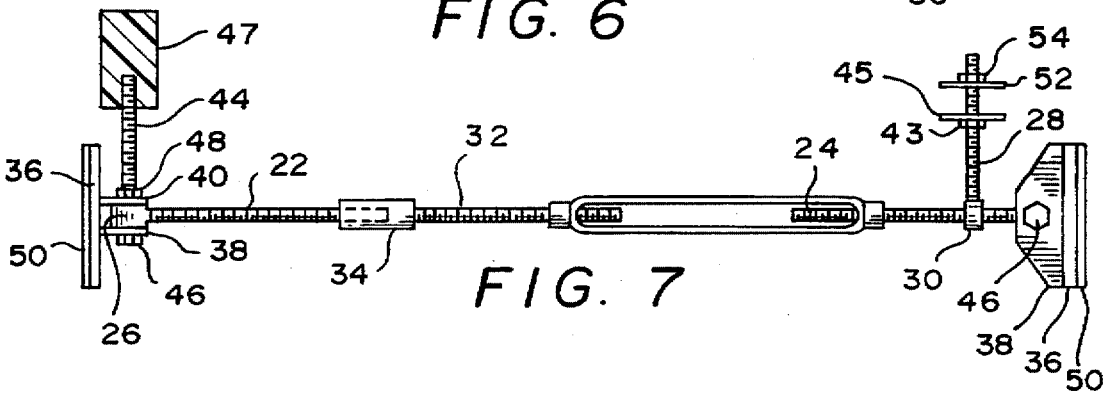
FIG. 7 illustrates an assembled window bar device using an extension as shown in FIG. 3.

FIG. 3 illustrates an extension rod which includes a threaded rod 32 secured to an elongated threaded nut 34. It is used for extra wide or extra long window openings which require a bar device longer than the type shown in FIG. 1. The elongated nut would thread onto one end of one of the threaded rods which is secured to a support pad. The threaded rod end 32 would thread into one end of the turnbuckle. The length of the extension and threaded rods with the eyelet are dictated by the height and/or width of the opening to be protected. The extension shown in FIG. 3 is illustrated in FIG. 7 for use with extra wide windows.

Figure 4:
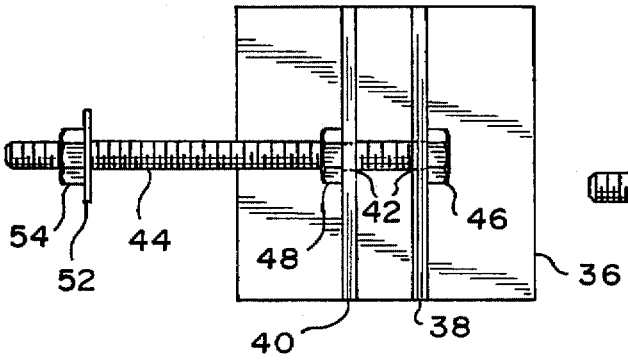
FIGS. 4 and 5 illustrate different views of a support pad for a window bar device.
Figure 5:
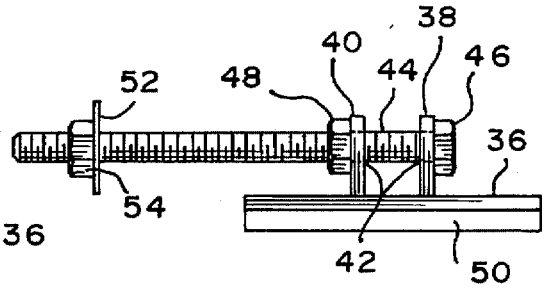

FIGS. 4 and 5 illustrate support pads 36 to which the eyelets 26 of the threaded rods 22 and 24 are secured. As shown the support pad 36 is preferably made of metal in a square block of any preferred size depending on its use with wood, concrete, brick blocks, etc. The supporting pad has spaced ears 38, 40 which extend outwardly therefrom perpendicular to one surface of the support pad. The spaced ears are provided with aligned apertures 42 shown by dotted line in which their axis is parallel with the surface of the pad. The support pads are shown with pivot bolts 44 that pass through the apertures in the ears and which are secured in place by the bolt head 46 on one side of one ear and a nut 48 on the opposite side of the other ear. These pivot bolts 44 secure the eyelet ends 26 of the threaded rods 22, 24 to the support pad 36. The support pad 36 is also shown with a rubber cushion 50 or some such protective covering that seats on an exterior wall element defining the window opening to support the bar device within the window opening.

Figure 8:
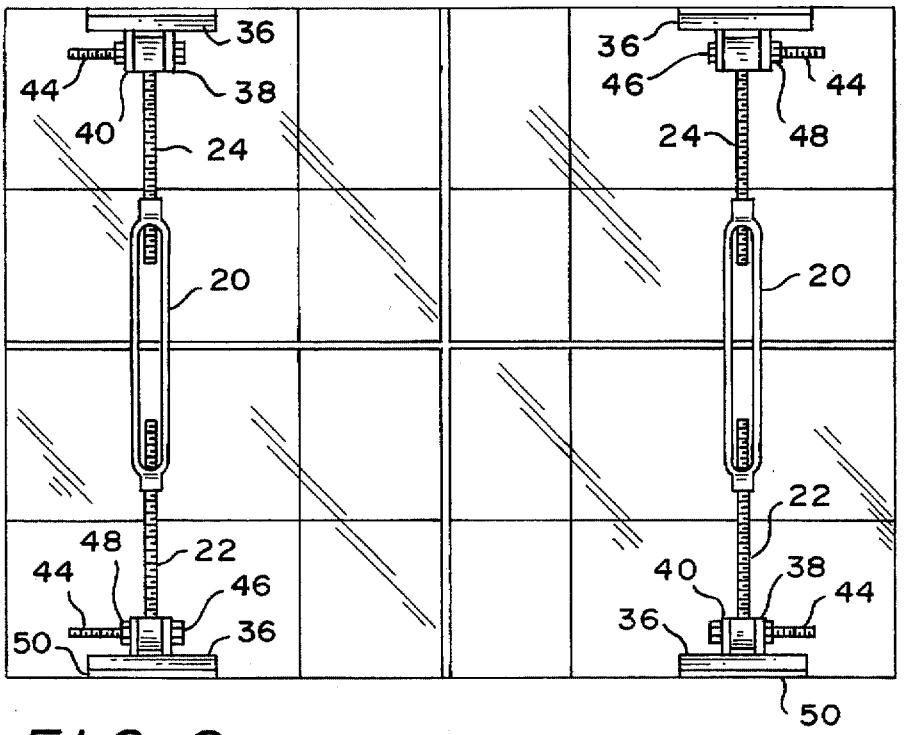
FIG. 8 illustrates two window bar devices which would be used for securing a piece of plywood over a window opening.
Figure 9:
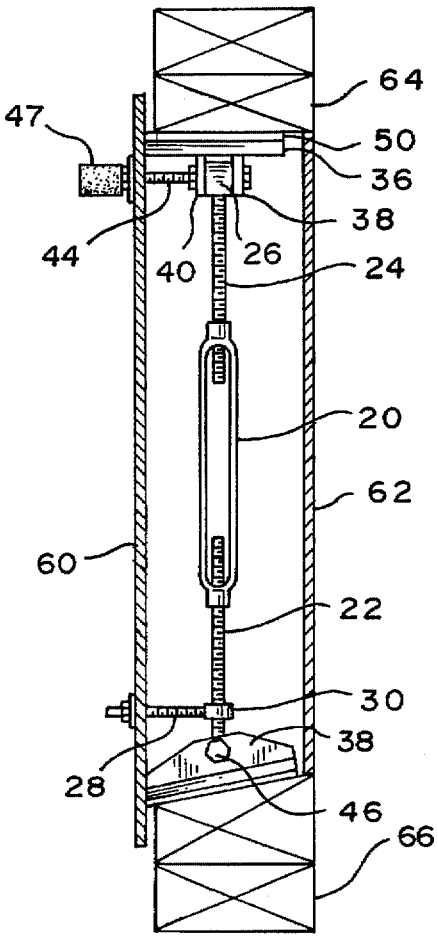
FIG. 9 illustrates a cross section of a window with a piece of plywood held over the window by a pair of window bar devices wherein only one bar device shown.

The bar device of FIG. 1 is used such as shown in FIGS. 6–9. As shown, the eyelets 26 of the threaded rods 22, 24 are secured to the support pads 36 by passing the pivot bolt 44 through one ear 38 through the eyelet 26 then through the opposite ear 40. The bolts 44 are held in place against the outer ear by the nut 48. The turnbuckle can then be rotated which moves the support pads to make contact with the brick, stone or frame window opening and is rotated sufficiently to secure the bar device in place. The end of the pivot bolts 44 are then fitted through appropriate holes in the plywood and the plywood is then secured in place on the threaded pivot bolts 44 by use of a washer 52 and nut 54. FIG. 9 also shows a window being protected and the outer end of the pivot bolts 44 are provided with a foam covering 47 shown on the left bolt or any other protector to protect against injury of someone that runs into the end of the bolt.

Some houses have very wide or very tall windows. FIG. 7 shows the extension rod 32 with the threaded coupling end 34 secured to the threaded rod 22 and the threaded rod 32 secured to the turnbuckle 20. The extension rod has threads that match the turnbuckle end and the coupling has internal threads that match with the threads on the end of the rod 22. A similar extension could be used on the opposite end if necessary.

Figure 2:
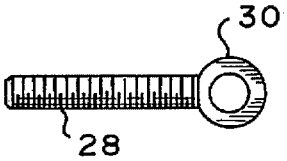
FIG. 2 illustrates an adapter bolt for use with a window bar device.

FIGS. 7 and 9 illustrate a bar device in a horizontal and vertical position, respectively, obviously the bar device can be secured in either position in similar fashion. The bar device of FIG. 9 is shown with one of the support pads at an angle because of the supporting surface being at an angle. In this case, an adapter bolt 28 as shown in FIG. 2 is provided on the threaded rod 22 and secured to the plywood 60. The other securing bolt is the pivot bolt 44. It is known that the bottom sill of a window frame usually slopes downwardly so that water will drain off the sill. The support pad 36 on the bottom is shown with the lower side at an angle. The angular setting is so that the pad will rest against the window sill with a sloping angle similar to the window sill. The pivot bolt for the threaded rod eyelet 26 is rotated to a position in which it cannot be seen because of the angle of the support pad.

The bar device shown in FIG. 7, can be secured within a window opening and protected on the ends by use of the metal pad 36 which is provided with the protective cushion 50. The plywood can be secured to the bolts 44 by use of a washer 52 and nut 54 and the nut is screwed tight against the washer which would then force the plywood against the building facing, therefore, no air space is provided between the plywood and the building. In this arrangement the plywood could be moved up or down a little so that an air space would be provided at the upper or lower end. As shown in FIG. 9 the plywood is forced against the outer edge surface of the metal pad 36 and the plywood would be held against the metal pad so that if the metal pad is wide enough, an air space will be provided. If the end piece is not of such a width, then the plywood would be secured against the siding of the house.

Figure 6:
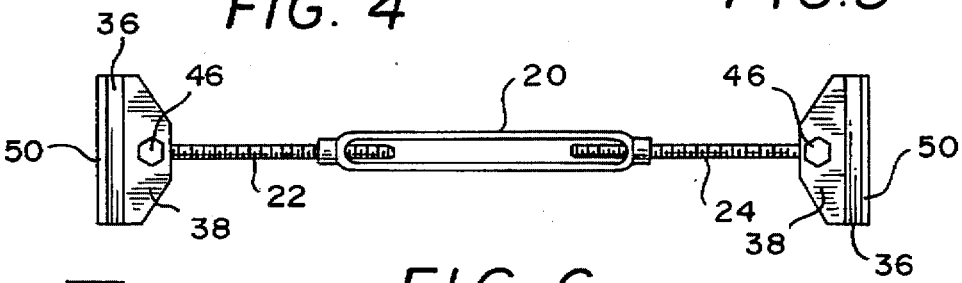
FIG. 6 illustrates an assembled window bar device ready for use.

FIG. 8 has been included to illustrate the manner in which a protective sheet such as plywood is secured over a window. As shown, two bar devices should be used for stabilization of the upper and lower ends of the protective sheet. FIG. 8 is shown with two bar devices such as illustrated in FIG. 6. The threaded pivot balls 44 are shown extending to the side for illustrative purposes. Of course, they should be extending outwardly in order to secure a protective sheet to the bar devices.

FIG. 9 shows the plywood seated against an edge surface of the metal blocks on both ends. In this arrangement a spacing can be left around the plywood between the plywood and the wall so that some air can be received by an open window. The closeness of the plywood to the wall would prevent debris from entering the space between the plywood and the window.

In order to secure the plywood against the supporting pads 36 or against a surface of the building, a nut 54 and washer 52 is used. For this support an extra nut 43 and washer 45 has been shown in FIG. 7. The inside nut would be threaded onto the threaded pivot bolt 44 or onto the adapter bolt 28 a desired distance then the inside washer would be placed over the end of the bolt and moved to the inside nut. The plywood would then be placed onto the bolts, and the outside washer and nut would be added to the end of the bolt. The outside nut and washer would force the plywood against the inside washer and if the inside nut and washer are out sufficiently a crack would be formed between the plywood and the building structure as shown in FIG. 9.

The support pad 36 can serve two purposes, it can serve as an end support for the ends of the threaded rods and also as a spacer for the plywood to form an air space between the plywood and the building. It would be obvious to one skilled in the art that the support pads 36 can be positioned anywhere along the inside of the window opening so that the securing bolts are extending beyond the wall of the building. If the plywood is to be placed against the edge of the support pads then the edge of the support pads must extend out beyond the wall of the building. If the plywood is secured to the bolts with a spacing between the wall of the building then the bolts must extend beyond the wall surface.

In order to secure the bar device and protective covering in place all that would be required is a drill for drilling holes in the plywood, a bar for tightening the turnbuckle and a crescent wrench or other suitable wrench to fit the nuts. In fact, the handle of the crescent wrench could be used to rotate the turnbuckle. It is obvious to one skilled in the art that rotation of the turnbuckle in the correct rotation would thread the threaded rods outwardly to tighten the support pads against the inside surface of the window opening. Sufficient rotation of the turnbuckle would secure the support pads in place juxtaposed the window. The padding on the outside of the support pad would prevent marring or otherwise damaging the frame or brick walls defining the window opening. The same end result is achieved whether the adapter bolts 28 are used on the threaded rods or the pivot bolts are used to secure the plywood to the bar device. Each assembly provides a threaded end of a bolt to which the plywood is secured. However, the support pads as shown in FIGS. 4 and 5 could space the plywood away from the building surface provided the support pads are wide enough and the plywood is in contact with the outer edge of the support pad.

Installation of the bar device as shown in FIG. 7 is as follows: The extension 32 is added to the threaded rod 22 and another extension could be added to the threaded rod 24, if necessary. The threaded rods 22 and 24 are threaded onto the turnbuckle 20 and the eyelet ends 26 of the threaded rods 22 and 24 are secured to the metal support pads by use of the pivot bolts 44. The pivot bolts are secured in place by the nut 48 and tightened against the ear 40. The bar device is then placed in the window opening with the threaded rods adjusted sufficiently so that the support pads just fit against the walls defining the window opening. The turnbuckle is then rotated in order to move the threaded rods outwardly in order to tighten the bar device in place. Once the bar device is tightened in place measurements for the holes in the plywood can be made and the holes drilled. The plywood is then placed onto the pivot bolts 44 to fit against a washer 45 on the pivot bolts held in place by a nut 43. If used on the outside of the plywood then the washers 52 and nuts 54 are applied. If the inside nut and washer is not used the plywood would be drawn tightly against the area of the building surrounding the window or against the outer surface of the support pads. If the inside nut and washer is used then the nuts would be threaded onto the bolts sufficiently to secure the plywood with a spacing between the plywood and the building. If an adapter bolt or bolts are used, it is preferred that the adapter bolt be threaded onto the threaded rods, however, the eyelets of the adapter bolts could be without threads and slide onto the threaded rods. If the plywood is secured against the building the adapter bolts would not slip along the threaded rods.

The bar device of FIG. 9 is shown with one adapter bolt 28 and one pivot bolt 44. The adapter bolt is threaded onto the threaded rod 22 or slid onto the threaded rod if the eye of the adapter bolt does not have threads. As shown, the support pads are secured to the eyelets 26 of the threaded rods 22 and 24 and held in place by the threaded pivot bolts 44 and the nut 48. The turnbuckle 20 would be rotated to secure the end supports in place in the window opening. Plywood or any other suitable protective covering with the drilled holes in the proper places will be assembled onto the ends of the adapter bolt 28 and the threaded pivot bolt 44. The washer and nut would be applied to the ends of the threaded adapter bolt and pivot bolt and drawn taut. The plywood would be forced against the edges of the support pads and held in place against the support pad; that is, if the end support is wide enough to extend beyond the building wall, as shown. If not, the plywood will be forced against the building surface and held in place. FIG. 9 illustrates the window 62, the plywood 60, and the sides 64, 66 of the window opening.

Therefore the reader should see that a protective covering can be installed easily and quickly to prevent damage to windows of a building and the window area during a storm. Further, one should understand that the protective covering can be secured in place by the use of a pivot bolt 44 at each end of the threaded rods 22, 24 or by one pivot bolt and one adapter bolt as shown in FIG. 9 or by an adapter bolt at each end of the threaded rods so that the protective covering is secured to two adapter bolts instead of the threaded pivot bolts 44.

During hurricane season the bar device could be mounted and left secured in the window opening because it does not block the view through the window very much. By leaving the bar device mounted in the window opening it would take very little time to attach the plywood to the retaining bolts. Since the bar device is small and secured to the framing or window opening, the bar device permits opening and closing of a window vertically or inwardly and would not restrict opening a window except for a window that would open outwardly.

Since the device can be easily and quickly installed by unskilled personnel, the applicant has proposed that the device be known by a trademark HURRI-BAR which is a quickly installed bar for supporting a protective covering over a window during a storm.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A bar device which is used to support a protective covering over a window of a building to prevent damage to the window during a storm, said bar device comprises a turnbuckle, said turnbuckle including an elongated main body having first and second threaded ends, said first threaded end having a right hand thread and said second threaded end having a left hand thread a first and second threaded rod, each of said first and second threaded rods having an inner end and an outer end, said first threaded rod having a right hand thread along its length connecting said inner end with said first threaded end of said turnbuckle, said second threaded rod having a left hand thread over its length connecting said inner end with said second threaded end of said turnbuckle, a first rod support means secured to said outer end of said first threaded rod, a second rod support means secured to said outer end of said second threaded rod, each of said first and second rod support means includes a flat surface support pad that forms a first side thereof and connecting means on a second side thereof connected to said outer end of its corresponding threaded rod for protection of a window frame surface from damage by said outer ends of said first and second threaded rods when said bar device is secured between opposite window wall surfaces of a window frame opening, a first adapter bolt means secured to said first threaded rod between said main body of said turnbuckle and said first rod support means secured to the outer end of said first threaded rod, a second adapter bolt means secured to said second threaded rod between said main body of said turnbuckle and said second rod support means secured to the outer end of said second threaded rod, each of said first and second rod support means are extending from said first and second threaded rods respectively at an angle relative thereto whereby said protective covering is adapted to be secured by said first and second adapter bolt means to said threaded rods and over said window for protecting said window from damage caused by the storm.

2. A bar device as set forth in claim 1, in which said outer end of each of said first and second threaded rods is formed as an eyelet and said outer end of each of said first and second threaded rods is pivotably secured to one of said support pads.

3. A bar device as set forth in claim 2, in which at least one of said support pads is made of metal.

4. A bar device as set forth in claim 3, in which each of said supporting means on said metal flat surface support pads comprises spaced parallel ears perpendicularly to secured said first side of said support pad, each of said ears includes a bolt hole therein which mates with said eyelet in said outer end of one of said threaded rods, and a threaded pivot bolt being secured in each of said bolt holes in a pair of said ears and secured to the eyelet on said outer end of one of said threaded rods, and said threaded pivot bolts extend outwardly from the bar device whereby said protective covering is adapted to be secured to said bar device relative to a window to be covered by said protective covering.

5. A bar device as set forth in claim 4, in which each of said metal plates has a width adapted to fit into said window opening and to extend outwardly of a wall of said building whose window is to be protected whereby the protective covering is adapted to be secured against an edge surface of said metal plate when assembled in place over the window to provide a spacing between the protective covering and the building.

6. A bar device as set forth in claim 2, in which at least one of said support pads includes a protective cushion on said flat surface support pad.

7. A bar device as set forth in claim 2, in which each of said connecting means comprises spaced parallel ears perpendicularly secured to said second side surface, each of said ears includes aligned apertures having an axis parallel with said second side surface of said flat surface support pad, a threaded pivot bolt passing through said apertures in each of said parallel spaced ears and the corresponding eyelet of each of said first and second rods securing said outer end of one of said threaded rods to one of said support pads, each of said pivot bolts extending from one of said pair of ears outwardly of one of said support pads whereby each of said pivot bolts has a means adapted to secure said protective covering to one of said threaded pivot bolts to cover said window opening.

8. A bar device as set forth in claim 7, in which each of said pivot bolts further includes at least one washer and nut by which said protective covering is adapted to be secured to said threaded pivot bolt.

9. A bar device as set forth in claim 8, in which each of said threaded pivot bolts includes at least two washers and two nuts whereby said protective covering is adapted to be secured to said bar device to cover said window opening.

10. A bar device as set forth in claim 7, which includes at least one threaded extension bolt which is connected at a first end to said turnbuckle and at a second end to one end of one of said threaded rods.

11. A bar device as set forth in claim 1, in which at least one of said support pads is made of metal.

12. A bar device as set forth in claim 1, in which at least one of said support pads includes a protective cushion on said flat surface support pad.

13. A bar device as set forth in claim 1, which includes at least one threaded extension bolt which is connected at a first end to said turnbuckle and at a second end to one end of one of said threaded rods.

14. A bar device as set forth in claim 2, which includes at least one threaded extension bolt which is connected at a first end to said turnbuckle and at a second end to one end of one of said threaded rods.

* * * * *